US005385157A

United States Patent [19]

Smith et al.

[11] Patent Number: 5,385,157

[45] Date of Patent: Jan. 31, 1995

[54] CIGARETTE SNUFFING AND STORING DEVICE

[76] Inventors: Kenneth Smith; Adam Pliska, both of 1266 San Lucia Ave., Porterville, Calif. 93257

[21] Appl. No.: 97,280

[22] Filed: Jul. 23, 1993

[51] Int. Cl.[6] ..... A24F 13/18

[52] U.S. Cl. ..... 131/256; 131/235.1

[58] Field of Search ..... 131/256, 235.1, 231, 131/178; 206/242, 246, 528, 37, 496; D27/102, 136, 138

[56] References Cited

U.S. PATENT DOCUMENTS

| | | | |
|---|---|---|---|
| D. 292,622 | 11/1987 | Meyers et al. | D27/9 |
| D. 303,438 | 9/1989 | Higgins | D27/136 |
| 2,120,027 | 6/1938 | Johnson | 131/256 |
| 2,335,674 | 11/1943 | Horlick | 131/256 X |
| 2,536,302 | 1/1951 | Mertzel | 131/256 |
| 3,888,264 | 6/1975 | Baclit | 131/235.1 |
| 4,587,980 | 5/1986 | Tipper | 131/256 X |
| 4,660,575 | 4/1987 | Andreason et al. | 131/256 |
| 4,682,611 | 7/1987 | Chiu-Rong | 131/256 |
| 4,777,968 | 10/1988 | Beloff | 131/256 |
| 4,809,715 | 3/1989 | Musetti | 131/256 |
| 4,907,604 | 3/1990 | Beloff | 131/256 |
| 5,002,073 | 3/1991 | Chiang | 131/178 |

FOREIGN PATENT DOCUMENTS

| | | | |
|---|---|---|---|
| 2749624 | 5/1979 | Germany | 131/235.1 |

*Primary Examiner*—Jennifer Bahr

*Attorney, Agent, or Firm*—Macro-Search Corp.

[57] ABSTRACT

An apparatus is provided for extinguishing and storing a cylindrical smoking material, such as a cigarette or a cigar. A cylindrical body has open ends, one of which is for receiving the smoking material. A cylindrical cap has an open end adapted to snugly receive the one open end of the cylindrical body. As such, the one open end of the cylindrical body may be capped in a substantially airtight manner. A hollow cylindrical plug has an open end for providing access to an interior cavity of the plug. A flexible screen covering the open end of the plug extends away from the open end of the plug and fits snugly within the other end of the cylindrical body in a substantially airtight manner. The cylindrical plug includes a non-smooth surface for facilitating gripping thereof. As such, the smoking material may be inserted into the one open end of the cylindrical body, which is then capped by the cylindrical cap, thereby smothering the smoking material within the airtight cylindrical body. Ashes from the smoking material are retained within the interior cavity of the plug, which may be emptied or cleaned periodically.

3 Claims, 2 Drawing Sheets

CIGARETTE SNUFFING AND STORING DEVICE

FIELD OF THE INVENTION

This invention relates generally to cigarette snuffing and storing devices, and, more particularly, is directed towards a portable, easily emptied and cleaned snuffing and storing device.

BACKGROUND OF THE INVENTION

Quite a variety of cigarette extinguishing and storing devices exist in the prior art. Many of these devices take the shape of a simulated ball-point pen, and include a cap that is adapted to cover one end of an elongated body for storing the cigarette or smoking material. For example, U.S. Pat. No. 4,660,575 to Andreason et al. on Apr. 28, 1987, illustrates such a device, as does U.S. Pat. No. 4,777,968 to Beloff on Oct. 18, 1988, and U.S. Pat. No. 4,809,715 to Musetti on Mar. 7, 1989. Such devices typically smother the burning smoking material within the elongated storage body by capping one or more open ends of the elongated body and preventing the replenishment of oxygen within the body.

Such prior art devices have significant drawbacks. For example, the burning end of the cigarette or cigar is often forced into contact with an extinguishing member of such devices. This tends to break away ashes from the smoking material, such ashes collecting within the device. None of the prior art devices include a means for easily removing such ashes in a clean manner. While the Andreason et al. reference does include a removable plug at the bottom end of their device, the plug is not easily removed without spilling ashes from the device. Further, such a plug is not meant to retain ashes, even temporarily, and therefore must be removed from the device with the utmost care and usually while the device is held over a trash can or other suitable receptacle. Other prior art devices make no provision for ashes that may break away from the smoking material, and therefore even a clean cigarette stored in such a device can quickly collect ashes from previous cigarettes while being stored within such devices.

Clearly, then, there is a need for a cigarette storing and extinguishing device that provides an easy means for emptying ashes therefrom in a clean manner. Such a needed device would extinguish any smoking materials without allowing smoke to escape the device. Further, such a needed invention would preserve the smoking materials for future consumption without damaging or dirtying the smoking material. The needed device would be compact, easily portable, and extremely simple to manufacture. The present invention fulfills these needs and provides further related advantages.

SUMMARY OF THE INVENTION

The present invention is a device for extinguishing and storing a cylindrical smoking material, such as a cigarette or a cigar. A cylindrical body has open ends, one of which is for receiving the smoking material. A cylindrical cap has an open end adapted to snugly receive the one open end of the cylindrical body. As such, the one open end of the cylindrical body may be capped in a substantially airtight manner. In one embodiment of the invention, the cylindrical cap includes a protruding ridge around its inside surface. The one open end of the cylindrical body provides a corresponding detent around its outside surface. As such, the ridge of the cap engages the detent of the cylindrical body for providing a positive locking action of the cap with the body. Similarly, the open end of the cylindrical body includes a second protruding ridge around its inside surface. As such, the smoking material is frictionally held by the second protruding ridge when the material is inserted into the one open end of the cylindrical body. A hollow cylindrical plug has an open end for providing access to an interior volume of the plug. A flexible screen covering the open end of the plug extends away from the open end of the plug and fits snugly within the other end of the cylindrical body in a substantially airtight manner. Preferably, the cylindrical plug includes a non-smooth surface for facilitating gripping thereof.

In use, the device is generally kept upright, with the one end of the cylindrical body oriented vertically upward. With the other end of the cylindrical body plugged with the cylindrical plug, the smoking material is inserted into the one open end of the cylindrical body, which is then capped with the cylindrical cap. As such, the smoking material is smothered within the substantially airtight cylindrical body. Further, ashes that break away from the smoking material are captured in the interior volume of the cylindrical plug, which may be periodically removed from the other end of the cylindrical body and emptied or cleaned.

The present invention is a cigarette storing and extinguishing device that provides an easy means for emptying ashes therefrom in a clean manner. The present device extinguishes smoking materials without allowing smoke to escape from the device. Further, the present invention preserves the smoking materials for future consumption without damaging or dirtying the smoking material. The present device is compact, easily portable, and extremely inexpensive to manufacture. Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENT

Figure 1:
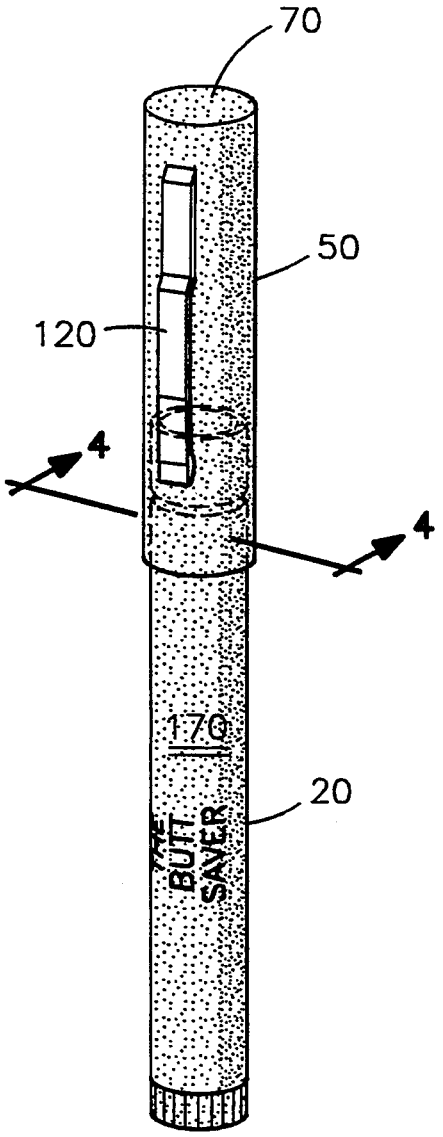
FIG. 1 is a perspective illustration of the invention, showing a cylindrical body, a cylindrical cap, and a cylindrical plug of the invention.
Figure 2:
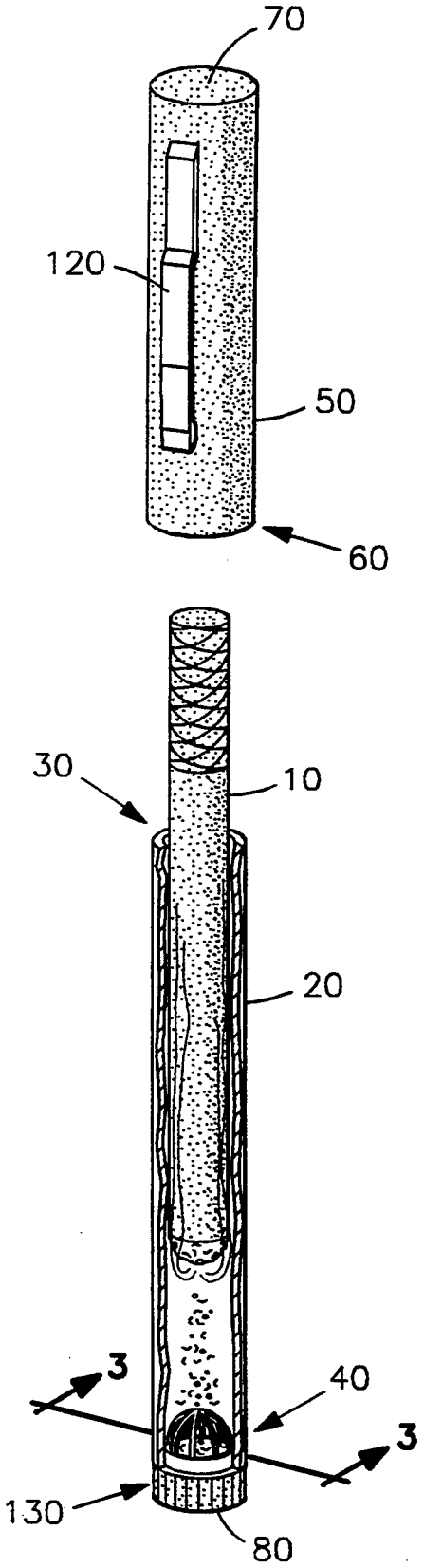
FIG. 2 is a partially exploded, partially broken away perspective illustration of the invention, showing a smoking material held within the cylindrical body and ashes from the smoking material falling into an interior volume of the cylindrical plug.

FIGS. 1 and 2 show a device for extinguishing and storing a cylindrical smoking material 10, such as a tobacco cigarette or a cigar. A cylindrical body 20 has open ends. One of the open ends 30 is for receiving the smoking material 10. Preferably, the cylindrical body 20 in manufactured from a suitably rigid and heat resistant material, such as plastic or metal. Such a cylindrical body 20 may be easily manufactured by extrusion, for example.

A cylindrical cap 50 has an open end 60 adapted to snugly receive the one open end 30 of the cylindrical body 20. As such, the one open end 30 of the cylindrical body 20 may be capped in a substantially airtight manner. In one embodiment of the invention, the cylindrical cap 50 includes a flexible spring clip 120 attached to the outside of the cap 50 for removably attaching the device to an thin, arbitrary support (FIG. 2), such as a shirt pocket or the like. The cap 50 is preferably made from the same rigid material as is the cylindrical body 20.

Figure 4:
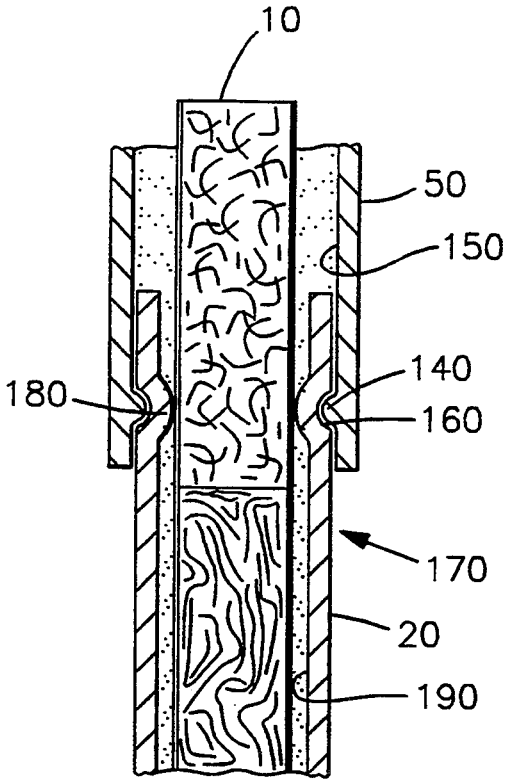
FIG. 4 is a cross-sectional view of the invention, taken generally along lines 4—4 of FIG. 1, showing a protruding ridge of the cylindrical cap engaged with a corresponding detent of the cylindrical body, and further showing a second protruding ridge of the cylindrical body frictionally holding the smoking material.

In one embodiment of the invention, the cylindrical cap 50 includes a protruding ridge 140 around an inside surface 150 thereof (FIG. 4). The one open end 30 of the cylindrical body 20 provides a corresponding detent 160 around an outside surface 170 thereof (FIGS. 1 and 4). As such, the ridge 140 of the cap 50 engages the detent 160 of the cylindrical body 20 for providing a positive locking action of the cap 50 with the body 20. Similarly, the open end 30 of the cylindrical body 20 includes a second protruding ridge 180 around an inside surface 190 thereof. As such, the smoking material 10 is frictionally held by the second protruding ridge 180 when the material 10 is inserted into the one open end 30 of the cylindrical body 20. The smoking material 10 is therefore prevented from internal movement and impact within the body 20, which normally causes tobacco loosening and other effects.

Figure 3:
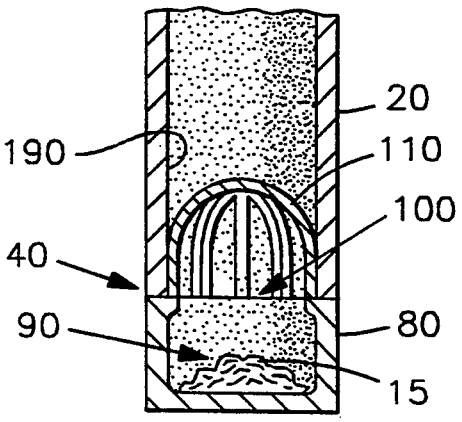
FIG. 3 is a cross-sectional view of the invention, taken generally along lines 3—3 of FIG. 2, showing the interior volume and a friction member of the cylindrical plug.

A hollow cylindrical plug 80 has an open end 100 for providing access to an interior cavity 90 of the plug 80. A friction member 110 such as a flexible screen is adapted to encompass covering the open end 100 of the plug 80, and extends away from the open end 100 of the plug 80 and fits snugly within the other end 40 of The frictional member 110 has a diameter so as to require a forceful fit of the frictional member 110 within the cylindrical body 20. The frictional member 110 preferably is a flexible screen adapted to compress for fitting within the cylindrical body 20 and for exerting outwardly directed force on the inside surface 190 cylindrical body 20 for holding the plug in position, the screen thereby frictionally holds the plug 80 in position in the cylindrical body 20 in a substantially airtight manner (FIG. 3). Preferably, the cylindrical plug 80 includes a non-smooth surface 130 for facilitating gripping thereof, for improved ease of removal and replacement. Plug 80 is preferably made of a heat resistant material such as metal or certain heat resistance plastics.

In use, the device is generally kept upright, with the one end 30 of the cylindrical body 20 oriented vertically upward. With the other end 40 of the cylindrical body 20 plugged with the cylindrical plug 80, the smoking material 10 is inserted into the one open end 30 of the cylindrical body 20 and the cylindrical body 20 is capped with the cylindrical cap 50. As such, once the oxygen contained within the cylindrical body 20 has been consumed by the burning smoking material 10, the smoking material 10 is smothered within the substantially airtight cylindrical body 20. Further, ashes 15 that break away from the smoking material 10 are captured in the interior cavity 90 of the cylindrical plug 80. At a later time, naturally, the smoking material 10 may be removed and consumed. The plug 80 may be periodically removed from the other end 40 of the cylindrical body 20 and emptied or cleaned. The friction member 110 provides improved ability to handle the plug 80 when filled with ashes 15 so that the ashes 15 are not spilled during handling of the plug 80.

While the invention has been described with reference to a preferred embodiment, it is to be dearly understood by those skilled in the art that the invention is not limited thereto. Rather, the scope of the invention is to be interpreted only in conjunction with the appended claims.

I claim:

1. A device for extinguishing and storing a cylindrical smoking material comprising:

a cylindrical body having open ends and an interior diameter, one open end for receiving the cylindrical smoking material;

a cylindrical cap having an open end adapted to snugly receive the one open end of the cylindrical body therewithin for capping the one open end of the cylindrical body in a substantially airtight manner;

a hollow cylindrical plug having an open end for providing access to an interior cavity of the plug and a dome shaped flexible screen adapted to encompass the open end of the plug, the screen having a diameter such as to require a forceful fit within the cylindrical body, the screen being adapted to compress for fitting within the cylindrical body and for exerting outward directed force on the cylindrical body for holding the plug in position, the screen thereby frictionally holding the plug in position in the body.

2. The device of claim 1 wherein the cylindrical cap includes a flexible clip attached to the outside thereof for removably attaching the device to an arbitrary support.

3. The device of claim 1 wherein the open end of the cylindrical cap includes an protruding ridge around an inside surface thereof, and wherein the one open end of the cylindrical body provides a detent around an outside surface thereof, whereby the ridge of the cap engages the detent of the cylindrical body for providing a positive locking action of the cap on the body, the ridge engaging the smoking material.

* * * * *